US007935397B2

(12) United States Patent
Okuda et al.

(10) Patent No.: US 7,935,397 B2
(45) Date of Patent: May 3, 2011

(54) INK JET RECORDING MEDIUM AND INK JET RECORDING METHOD

(75) Inventors: Teruaki Okuda, Tokyo (JP); Yoshiyuki Nagase, Kawasaki (JP); Nobuo Tokutake, Kawasaki (JP); Asako Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1069 days.

(21) Appl. No.: 11/693,064

(22) Filed: Mar. 29, 2007

(65) Prior Publication Data

US 2007/0231511 A1 Oct. 4, 2007

(30) Foreign Application Priority Data

Mar. 31, 2006 (JP) ..... 2006-098787
Mar. 16, 2007 (JP) ..... 2007-068846

(51) Int. Cl.
*B41M 5/00* (2006.01)

(52) U.S. Cl. ..... 428/32.2; 428/32.3; 428/32.34; 428/32.35; 347/101; 347/105; 347/106; 427/245

(58) Field of Classification Search ..... 428/32.2, 428/32.3, 32.34, 32.35; 347/101, 105, 106; 427/245

See application file for complete search history.

(56) References Cited

U.S. PATENT DOCUMENTS

| | | | | |
|---|---|---|---|---|
| 5,750,200 | A * | 5/1998 | Ogawa et al. | 427/361 |
| 6,528,146 | B2 | 3/2003 | Okuda et al. | |
| 6,626,531 | B2 | 9/2003 | Fujii et al. | 347/105 |
| 7,763,333 | B2 * | 7/2010 | Kato et al. | 428/32.24 |
| 2003/0072925 | A1 * | 4/2003 | Kiyama et al. | 428/195 |
| 2003/0081103 | A1 * | 5/2003 | Ishimaru et al. | 347/105 |
| 2004/0090513 | A1 | 5/2004 | Ohya et al. | |
| 2008/0038491 | A1 * | 2/2008 | Ikeda et al. | 428/32.25 |

FOREIGN PATENT DOCUMENTS

| | | | |
|---|---|---|---|
| EP | 1 160 097 | A2 | 12/2001 |
| EP | 1 437 227 | A1 | 7/2004 |
| JP | 2001-287442 | A | 10/2001 |
| JP | 2002-307810 | A | 10/2002 |
| JP | 2004-268287 | A | 9/2004 |

* cited by examiner

*Primary Examiner* — Betelhem Shewareged
(74) *Attorney, Agent, or Firm* — Fitzpatrick, Cella, Harper & Scinto

(57) ABSTRACT

A high quality ink jet recording medium with a printed image non-vulnerable and excellent in scratch resistance is obtained with an ink jet recording using a water pigment ink. An ink jet recording medium having a substrate and an ink receiving layer including an inorganic particle and a binder on the substrate is provided. A surface of the ink receiving layer has (a) a projected valley portion depth (Rvk) of not less than 20 nm and not more than 100, (b) an arithmetic average roughness (Ra) of not less than 5 nm and not more than 100 nm, and (c) an average spacing (S) of local peaks of not more than 1.0 μm.

5 Claims, 2 Drawing Sheets

INK JET RECORDING MEDIUM AND INK JET RECORDING METHOD

BACKGROUND OF THE INVENTION

1. Field of the Invention

The present invention relates to an ink jet recording medium that can be suitably used for an ink jet recording method using an ink containing pigment.

2. Description of the Related Art

Heretofore, as an ink jet recording medium used for an image formation by an ink jet recording method, there have been known mediums having a variety of constitutions. Nowadays, however, it has come to be used for the output of electronic image information for computers and networks as well as for the output or the like of image information collected by digital cameras, digital videos, scanners, and the like. In this way, widened applications and improved functions of the recording apparatus (printer) by the ink jet recording method are recently noticeable. Hence, demands for the performance of the ink jet recording medium has become further diversified and become those for higher levels.

With development of the higher resolution of the output image as described above, the amount of ink printed on a recording medium from an ink jet printer has a tendency to increase. Hence, as the ink jet recording medium of a high absorption type capable of receiving a large amount of ink, a recording medium provided with an ink receiving layer including inorganic porous particles, such as silica and alumina hydrate, and a binder, such as water soluble resin, on a substrate has come to be used. This recording medium can enhance ink absorbency by allowing the inorganic porous particles to absorb dyes in the ink.

On the other hand, while water soluble dyes have been widely used in the prior art as an ink for the ink jet, an aqueous ink including a pigment as a coloring material has come to be used with a view to improving weather resistance of the ink jet recording medium. The ink jet recording medium using the aqueous pigment ink as described is, as compared with recorded products using a dye ink, extremely excellent with regards to discoloration due to the light such as ultraviolet rays and discoloration of the image caused by a slight amount of gas existing in the atmospheric environment.

Here, the size of pigment particles (hereinafter, referred to as "pigment ink particles") in the pigment ink is generally about 100 nm. Hence, when the conventional ink jet recording medium including the alumina hydrate of not less than 100 nm and not more than 200 nm in particle size and the inorganic particles such as silica is used, printed pigment ink particles remain on the uppermost layer portion of the ink receiving layer of the ink jet recording medium. Consequently, color developability of the printed product is extremely excellent, and its glossiness becomes also excellent. On the other hand, however, the pigment ink particles merely stick to the ink jet recording medium surface, and this has caused a problem that the pigment ink is liable to be scraped off by scratching and the like with a result that the image becomes extremely vulnerable (weak in scratch-resistance performance).

Further, as another ink jet recording medium, an ink jet recording medium having an ink receiving layer including wet silica and the like of about several μm in particle size can be cited. When this ink jet recording medium is used, printed pigment ink particles penetrate into a gap between the inorganic particles of about several μm comprising the recording medium and reach the inner most place of the ink receiving layer, so the pigment ink particles do not remain on the uppermost surface of the ink receiving layer. Hence, while being excellent in scratch-resistance, since the pigment ink particles have sank deep into the ink receiving layer, sufficient color development performance of the printed product has not been obtained.

Further, nowadays, as a substitute for silver halide photography, a so-called glossy paper having a 20° specular gloss of not less than 10% according to JIS-Z-8741 is required as the ink jet recording medium. Here, to be excellent in scratch resistance, when a wet silica of about several μm was used, only a non-glossy matte paper having a 20° specular gloss of not more than 1% has been able to be obtained as an ink jet recording medium. This has created a problem that the characteristic required as a glossy paper is not satisfied.

Hence, heretofore, the manufacture of an ink jet recording medium that can achieve excellent image properties has been attempted, which allows coloring materials to remain on the surface, and at the same time, has excellent scratch resistance after fixing the coloring materials on the surface.

Japanese Patent Application Laid-Open No. 2001-287442 describes a method of improving high gloss and image quality by allowing the surface of an ink receiving layer to have a crack and controlling the size of the crack. However, in the ink receiving layer having such a crack, similarly to the case where wet silica of about several μm in particle size is used, pigment ink particles reach the deepest place of the ink receiving layer from the crack, and the particle was hard to be fixed on the surface layer portion. For this reason, in the ink jet recording medium having printed pigment ink, color developability has been insufficient.

Further, with respect to the ink jet recording medium using the pigment ink, Japanese Patent Application Laid-Open No. 2002-307810 and Japanese Patent Application Laid-Open No. 2004-268287 describe a recording medium defining the surface roughness. However, in these ink jet recording mediums, achievement of both high color developability and high glossiness of a printed product, and improvement (improvement of scratch resistance performance) again vulnerability of a printed product has not been sufficiently studied.

SUMMARY OF THE INVENTION

As described above, in the conventional ink jet recording medium as represented by Japanese Patent Application Laid-Open No. 2001-287442, Japanese Patent Application Laid-Open No. 2002-307810 and Japanese Patent Application Laid-Open No. 2004-268287, high color developability and high glossiness, and scratch resistance performance of the printed product have not been simultaneously satisfied. Further, with respect to a method with which these characteristics are both made excellent, an adequate study has not been made yet.

Hence, as a result of the extensive researches conducted on the above described problem by the present inventors, it was found that the surface state of the ink receiving layer comprising the ink jet recording medium greatly affects the surface fixing ability and the scratch resistance of the pigment ink. That is, it was found that (a) the projected valley portion depth, (b) the average arithmetic roughness, and (c) the average spacing of a local peak, of an ink receiving layer greatly affect the surface fixing ability and the scratch resistance of the pigment ink, and these characteristics are required to be comprehensively controlled.

More specifically, the present invention aims at providing an ink jet recording medium in which the printed image formed with the water pigment ink is hard to be vulnerable and the scratch resistance performance is excellent, by comprehensively controlling the above described characteristics (a) to (c) in a predetermined range. Further, the invention aims at providing an ink jet recording medium which provides excellent color developability and glossiness and no cracks in the ink receiving layer.

To solve the above described objects, the present invention is characterized by the following constitution.

1. An ink jet recording medium having a substrate and an ink receiving layer including an inorganic particle and a binder on the substrate, wherein a surface of the ink receiving layer satisfies the following conditions:

(a) The projected valley depth (Rvk) is not less than 20 nm and not more than 100 nm.

(b) The arithmetic average roughness (Ra) is not less than 5 nm and not more than 100 nm.

(c) The average spacing (S) of the local peaks is not more than 1.0 μm.

2. The ink jet recording medium according to the item 1, wherein the inorganic particle is an alumina hydrate having an average secondary particle size of not less than 210 nm and not more than 300 nm.

3. The ink jet recording medium according to the item 1, wherein the inorganic particle is an alumina hydrate having an average secondary particle size of not less than 230 nm and not more than 300 nm, and wherein the ink receiving layer is formed by a rewet casting method.

4. The ink jet recording medium according to the item 1, wherein the projected valley portion depth (Rvk) is not less than 20 nm and not more than 60 nm.

5. A method of manufacturing the ink jet recording medium according to the item 1, wherein an ink receiving layer coating liquid containing an alumina hydrate having an average secondary particle size of not less than 230 nm and not more than 300 nm is applied on the substrate, and then a rewet casting is performed.

6. An ink jet recording method of forming an image on an ink jet recording medium by using an ink including a pigment as a coloring material, wherein the ink jet recording medium comprises a substrate and an ink receiving layer including an inorganic particle and a binder on the substrate, and wherein a surface of the ink receiving layer satisfies the following conditions:

(a) The projected valley depth (Rvk) is not less than 20 nm and not more than 100 nm.

(b) The arithmetic average roughness (Ra) is not less than 5 nm and not more than 100 nm.

(c) The average spacing (S) of the local peaks is not more 1.0 μm.

7. The ink jet recording method according to the item 6, wherein the projected valley portion depth (Rvk) is not less than ⅕ of the average particle size of the pigment.

8. The ink jet recording method according to the item 6, wherein the inorganic particle is an alumina hydrate having an average secondary particle size of not less than 210 nm and not more than 300 nm.

9. The ink jet recording method according to the item 6, wherein the projected valley portion depth (Rvk) is not less than 20 nm and not more than 60 nm.

According to the present invention, for the ink jet recording method using the water pigment ink, an ink jet recording medium can be obtained with which the printed image is non-vulnerable and has excellent scratch resistance, high color developability and excellent glossiness, and gloss characteristic having not less than half the gloss is provided.

Further features of the present invention will become apparent from the following description of exemplary embodiments with reference to the attached drawings.

DESCRIPTION OF THE EMBODIMENTS

Figure 4:
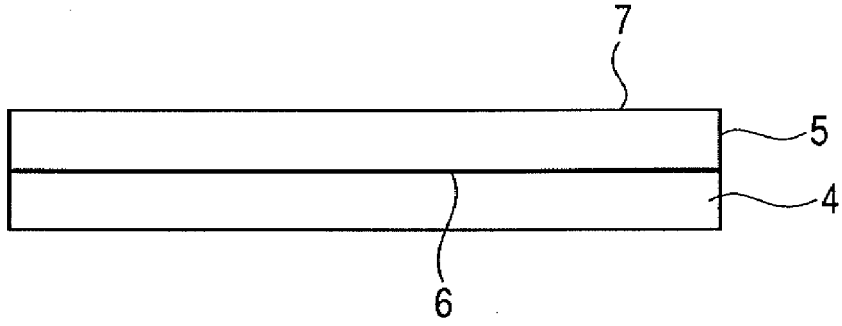
FIG. 4 is a view representing one example of the ink jet recording medium of the present invention.

In FIG. 4, one example of an ink jet recording medium of the present invention will be illustrated. The ink jet recording medium of the present invention has an ink receiving layer 5 on a substrate 4. The ink receiving layer 5 has one surface 6 in contact with the substrate 4 and the other surface 7 (surface on the side opposite the surface 6 in contact with the substrate) the surface profile of which is controlled. That is, the surface profile of the surface 7 is configured to have the following characteristics (a) to (c).

(a) The projected valley depth (Rvk) is not less than 20 nm and not more than 100 nm.

(b) The arithmetic average roughness (Ra) is not less than 5 nm and not more than 100 nm.

(c) The average spacing (S) of the local peaks is not more than 1.0 μm.

Incidentally, the substrate 4 and the ink receiving layer 5 may be of a multi-layer configuration, and both surfaces of the substrate 4 may be provided with the ink receiving layer 5.

As described in the Related Art of the present specification, for example, the Patent Japanese Patent Application Laid-Open No. 2002-307810 discloses an ink jet recording medium designed to improve the fixing ability of the pigment ink. In this ink jet printing medium, because of the above described characteristic, the arithmetic average roughness (Ra) of the surface according to JIS-B-0601 is controlled. In this conventional example, as a technique for controlling the average roughness (Ra), a method of improving the substrate supporting the ink receiving layer is suggested.

However, in the Patent Japanese Patent Application Laid-Open No. 2002-307810, the arithmetic average roughness (Ra) alone has been studied. The arithmetic average roughness (Ra), as regulated in JIS-B-0601, is nothing but an index representing on average an irregularity within the measurement range, and is not an index representing size or spacing of a recess portion or a projection portion. Hence, in the ink jet recording medium in the Patent Japanese Patent Application Laid-Open No. 2002-307810, merely the arithmetic average roughness (Ra) has been controlled, and no control has been made on the size and spacing of the recess portion or the projection portion.

Further, the estimation of the surface profile has not been appropriate since the surface profile is measured by using a needle having a curvature of several microns. Hence, the present inventors have found that, not in terms of the order of micrometers as disclosed in the conventional art, but the surface profile of the order of nanometers, particularly, the recess-projection profile and the characteristics of the recess portion/projection portion are extremely important in relation to the particle size of pigment ink particles. That is, as a result of the study using a probe microscope capable of measuring a nanometer profile of the uppermost layer of the ink receiving layer, it was found that the arithmetic average roughness, projected valley depth portion, and average spacing of the local peaks are important for the improvement of the scratch resistance performance of the printed image.

(Function and Action)

Hereinafter, in the ink jet recording medium of the present invention, the reason why the printed image is excellent in scratch resistance, color developability and glossiness by controlling the arithmetic surface roughness (Ra), the projected valley portion depth (Rvk) and the average spacing(S) of the local peaks will be described.

First, in the conventional ink jet recording medium, changing the surface profile of the support substrate of the ink jet recording medium for supporting the ink receiving layer has controlled the surface profile of the ink receiving layer. As this method, for example, a method of changing the surface profile of a RC paper or changing the support itself to the non-RC paper can be cited. However, such a method merely controls the surface roughness Ra which defines on average the recess-projection profile of the ink receiving layer surface, and no control has been made on the characteristics of the recess portion and the projection portion of the nanometer order cycle of the ink jet recording medium surface.

As a result, in such an ink jet recording medium, even when a desired arithmetic average roughness (Ra) was obtained, the spacing between the projection portion and the projection portion and between the recess portion and the recess portion has been a wide spacing of the micrometer order. Hence, physical adherence between the pigment ink having a particle size of about 100 nm printed on the ink jet recording medium and the ink jet recording medium surface has not been sufficient, and practically, the scratch resistance of the printed product has been unsatisfactory. The reason why the scratch resistance of the printed product is thus inferior in the conventional ink jet printing medium is because an anchoring of the recording medium to the pigment ink was unable to function, since its surface has a recess portion spacing and a projection portion spacing of a low cycle.

Hence, to allow the pigment ink particles to be fixed on the ink receiving layer surface and improve the scratch resistance performance of the printed product, it is important that the pigment ink particles adhere physically and strongly by the anchoring produced with the recess-projection profile of the ink receiving layer surface. In order to realize this anchoring, a control of not only the average recess-projection characteristic of the ink receiving layer surface as defined by the arithmetic average roughness, but also the recess portion characteristic (projected valley portion depth) and the projection portion characteristic (average spacing of the local peaks) becomes important. That is, a comprehensive control of the arithmetic average roughness, the projected valley portion depth, the average spacing of the local peaks is required for the particle size of the pigment ink.

Hereinafter, the relationship between each characteristic value (Ra, Rvk and S) and the effect of the present invention will be described.

(1) Average Spacing (S) of Local Peak

First, to allow the anchoring to be exhibited, the pigment ink particle is required to be embedded in the ink receiving layer surface. For this purpose, the ink jet recording medium surface is required to be formed with a projection profile at a spacing about several to ten times as longer than the particle size of the pigment ink particle. Specifically, the average spacing (S) of the local peaks which is an average spacing between the adjacent local peaks (projection portion) is required to be not more than 1.0 μm. When the average spacing (S) of the local peaks (for example, '8' in FIG. 1) exceeds 1.0 μm, the pigment ink particle is not effectively embedded between the adjacent local peaks (projection portion), and as a result, the anchoring between the pigment ink and the ink jet recording medium surface is not exhibited. Consequently, the ink jet recording medium becomes inferior in scratch resistance.

Further, when the average spacing (S) of the local peaks is in these ranges, a waviness component of the projection portion of a low cycle on the ink receiving layer surface does not become large, and the pigment ink particle is suitably embedded on the ink receiving layer surface. As a result, the anchoring between the pigment ink particle and the ink receiving layer surface is not reduced. Further, even when injured by a relatively sharp-edged object such as a human claw, the pigment ink on the ink receiving layer surface is not easily scraped off, nor is the white background of the ink receiving layer exposed, and high quality of the printed image can be maintained.

Thus, the average spacing (S) of the local peaks defines the spacing of the projection portions of the ink jet recording medium surface in order to finally exhibit the anchoring necessary for the improvement of adherence between the printed pigment ink and the recording medium (ink receiving layer).

Incidentally, for the measurement of the average spacing (S) of the local peaks, Nanopics 2100 made by Seiko Instrument Inc. was used. The curvature radius of the probe (needle) top end of this apparatus is about 20 nm.

In this apparatus, according to the procedure in which a measurement of one line is performed for 4 μm distance in the operating direction, and after that, the probe is moved in the direction vertical to the operating direction, and then, the measurement of one line is again performed, the measurement was performed in this order. By doing so, 256 lines were measured so that a region of 4 μm×4 μm was measured. Next, for the measurement of the average spacing (S) of the local peaks, ten lines from among the 256 lines measured in this way were sampled, and the mean value thereof was taken.

Next, the relationship between the fine surface profile (projected valley portion depth (Rvk) and the arithmetic average roughness (Ra) of the ink receiving layer surface and the effect of the present invention will be described provided that the average spacing (S) of the local peak is taken not more than 1 μm.

(2) Arithmetic Average Roughness (Ra)

In order to allow the anchoring to be exhibited for the pigment ink particle on the ink jet recording medium surface, not only the partial projection profile but also the profile of the entire surface is required to be controlled. That is, even when the average spacing (S) of the local peaks is not more than 1 μm, in case the surface profile (recess-projection profile) of the ink jet recording medium is smooth, the printed pigment ink particle is unable to enter inside the recess-projection portion on the ink jet recording medium surface. As a result, the anchoring becomes insufficient, and physical adherence between the printed pigment ink and the ink jet recording medium surface becomes inferior, and so sufficient performance cannot be provided with respect to the scratch resistance. Hence, not only the spacing between the projection portions represented by the average spacing (S) of the local peaks, but also the arithmetic average roughness (Ra) in consideration with the entire recess-projection profile (for example, the entire recess-projection profile of the evaluated length 3 in FIG. 1) is required to be not less than 5 nm and not more than 100 nm.

Here, in view of the relationship with the particle size of the pigment ink particle, when the arithmetic average roughness Ra exceeds 100 nm, the average space between the inorganic particles comprising the ink receiving layer becomes large. As a result, from that space, the pigment ink particle drops deep inside the ink receiving layer. In this case, since the pigment ink particle in charge of the color developability of the printed product does not remain on the ink receiving layer surface, it is advantageous as to the scratch resistance, but the color developability of the printed product is not fully satisfied. On the other hand, when the arithmetic average roughness (Ra) is less than 5 nm, the pigment ink particle is not embedded in the ink jet recording medium surface, and therefore, resulting in inferior scratch resistance.

More specifically, the arithmetic average roughness Ra can be not more than 70 nm, and can be not more than 60 nm, and can be not more than 50 nm in view of color developability. Further, in view of the scratch resistance, it can be not less than 20 nm, and can be not less than 30 nm, and can be not less than 40 nm.

(3) Projected Valley Portion Depth (Rvk)

Further, in order that the recording medium surface has a sufficient anchoring for the pigment ink, not only the entire recess-projection profile and the projection portion defined by the arithmetic average roughness (Ra), but also the recess portion defined by the projected valley portion depth (Rvk) is required to be controlled. That is, though the pigment ink particle is embedded in the ink jet recording medium surface by the control of the recess-projection profile and the projection portion, this pigment ink particle is further required to be closely sandwiched by the ink jet recording medium surface.

Hereinafter, the projected valley portion depth (Rvk) will be described. In order that the pigment ink particle closely adheres to the ink jet recording medium surface physically by the anchoring and the scratch resistance is improved, the recess portion having the size of the same order as the size of the pigment ink particle is required on the ink jet recording medium surface.

When the recess portion of the surface profile of the ink jet recording medium is small, that is, when the smoothness of the ink jet recording medium surface is high, the anchoring based on the close sandwiching between the surface and the pigment ink particle does not work, and therefore, the scratch resistance of the printed product does not become excellent.

Figure 2:
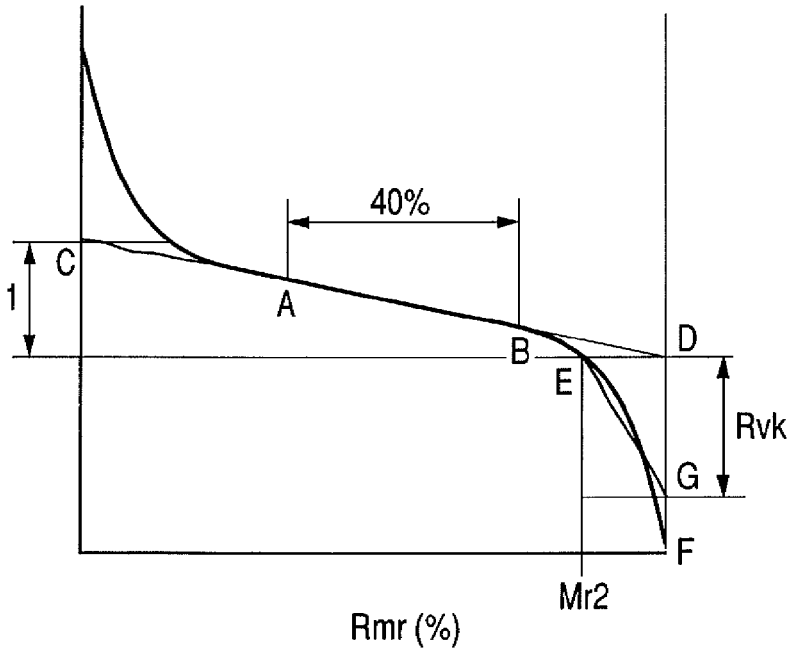
FIG. 2 is an explanatory drawing of the projected valley depth portion on a load curve.

The projected valley portion depth means the length of the line segment DG in the load curve obtained by using the axis of abscissas of the load length ratio (Rmr) according to JIS-B-0671 and the axis of ordinate of the measured height (depth) as shown in FIG. 2. Based on FIG. 2, the detail thereof will be described below.

First, the surface roughness curve is determined by the same method as that of the arithmetic average roughness (Ra). In FIG. 2, from among the straight lines passing through the two points on the load curve (A and B) where the difference between the Rmr values becomes 40%, the straight line having the least inclination is determined. The intersecting point between this straight line and the straight line of 100% Rmr is taken as a point D. The intersecting point between the straight line passing through this point D and being in parallel with the axis of abscissas and the load curve is taken as a point E. Further, the intersecting point between the load curve and the straight line of 100% Rmr is taken as a point F. At this time, the point on the 100% Rmr at which the graphical area surrounded by line segments DE, DF, and a curve EF becomes equal to the area of the triangle DEG is a point G, and the length of this line segment DG becomes the projected valley portion depth (Rvk).

Figure 1:
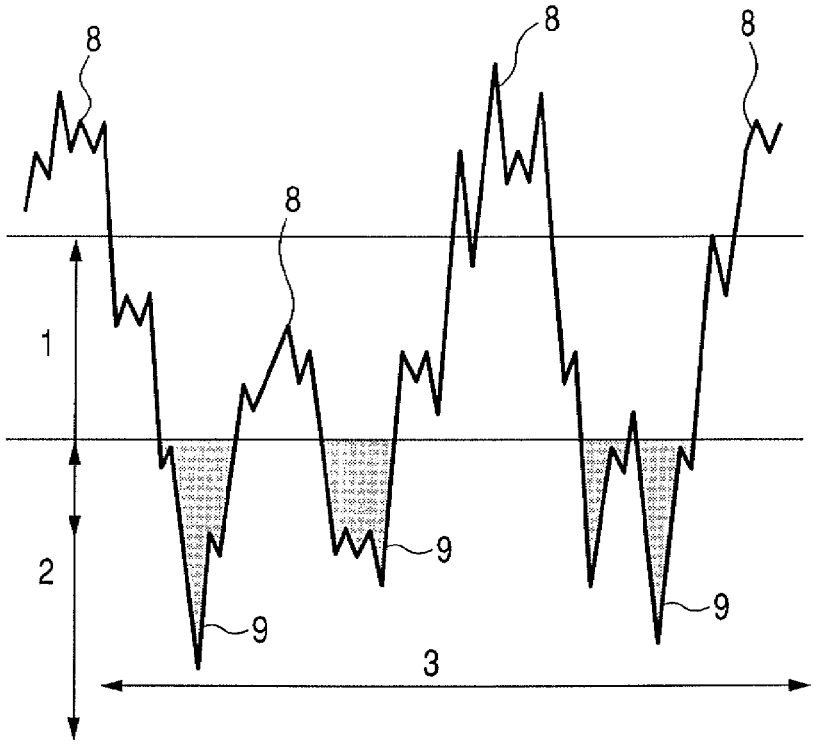
FIG. 1 is a view representing a roughness curve and a projected valley portion depth of an ink jet recording medium surface.

This projected valley portion depth (Rvk), as shown in FIG. 1 corresponds to the average depth of the black color portions of the roughness curve of the measured ink jet recording medium surface. The anchoring between the recording medium surface and the pigment ink particle depends on this projected valley portion depth (Rvk), that is, the size of the recess portion. This projected valley portion depth (Rvk) can be not less than ⅕ of the average particle size of the pigment ink to be used. Further, in view of the relationship with the particle size of the pigment ink particle, the depth becomes not less than 20 nm and not more than 100 nm. When the projected valley portion depth (Rvk) is in these ranges, a good anchoring based on the close sandwiching between the ink jet recording medium surface and the pigment ink particle embedded in the surface thereof is exhibited, and the scratch resistance of the printed product becomes excellent. Further, the space of the recess portion between the inorganic particles comprising the ink receiving layer becomes an adequate size for the pigment ink particle, and there does not happen that, from that space, the pigment ink particle drops deep inside the ink receiving layer of the ink jet recording medium. In this case, since the pigment ink particle in charge of the color developability of the printed product remains on the ink jet recording medium surface, the color developability of the printed product becomes satisfactory.

Incidentally, the projected valley portion depth (Rvk) can be not less than 20 nm and not more than 60 nm, and can be not less than 30 nm and not more than 60 nm, and can be not less than 40 nm and not more than 50 nm. When the projected valley portion depth (Rvk) is in these ranges, the pigment ink particle can be more effectively sandwiched by the anchoring by the recess portion of the ink receiving layer surface.

Incidentally, the control with respect to Rvk, Ra and S as described above has become verifiable for the first time by controlling the profile of the uppermost surface of the ink receiving layer in the order of nanometers and using the probe microscope capable of conducting measuring in the nanometer range. In the conventional ink jet recording medium, the profile of the ink receiving layer uppermost surface is controlled merely in the micrometer order, and this was confirmed by a probe type surface profile measuring apparatus defined by the appendix B of JIS-B-0651. Hence, neither the control nor the confirmation of the surface profile of the order of nanometers was performed. This is because, in this probe type surface profile measuring apparatus, the probes having a radius of the probe top end of 2 μm, 5 μm and 10 μm are used, and there is a limit to the measurement accuracy of a short-wave component, so that the confirmation of the surface profile of the order of nanometers was not accomplished.

As described above, in the present invention, the above described characteristics (a) to (c) are required to be comprehensively controlled, and independent control of any one of the characteristics is unable to achieve the ink jet recording medium excellent in scratch resistance, glossiness and image characteristic.

In order to configure the surface profile of the ink jet recording medium to satisfy the above described characteristics (a) to (c), a control can be performed by adjusting the particle size of the inorganic particle comprising the ink receiving layer and the binder content and performing a particular processing on the ink receiving layer. That is, by comprehensively controlling these characteristics, the ink jet recording medium satisfying the characteristics (a) to (c) can be achieved.

Each component (ink receiving layer and substrate) comprising the ink jet recording medium of the present invention will be described below.

1. Ink Receiving Layer (Inorganic Particle)

As the inorganic particle used for the ink receiving layer, an alumina hydrate having a secondary particle size of not less than 210 nm and not more than 300 nm, and more preferably not more than 280 nm can be used. When the secondary particle size of alumina hydrate is smaller than 210 nm, the pigment ink remaining on the ink receiving surface is hard to be subjected to the anchoring, and the scratch resistance performance is often hard to obtain. On the other hand, when the secondary particle size is larger than 300 nm, the pigment ink does not remain on the ink receiving layer surface, but enters deep inside the ink receiving layer, and color developability often becomes deteriorated.

Further, the BET specific surface area of alumina hydrate particles can be not less than 100 $m^2/g$ and not more than 200 $m^2/g$. When the BET specific surface area is larger than this, absorption of the solvent component of the ink becomes slow, and the fixing of the pigment ink particle on the ink receiving layer becomes slow, and an image smear is often generated. As a result, the quality of the printed product becomes deteriorated. On the other hand, when the BET specific surface area is smaller than this, the pigment ink particle does not remain on the ink receiving layer surface, but enters deep inside the ink receiving layer, and deteriorates the color developability of the image, so that the quality of the printed product often becomes deteriorated.

(Binder)

Further, as the material comprising the ink receiving layer, in addition to the above, a water soluble resin is required as a binder. As the water soluble binder, for example, polyvinyl alcohol and its modified products, vinyl acetate, oxidized starch, etherified starch, casein, gelatine, carboxycellulose, SB latex, NB latex, acryl latex, ethylene vinyl acetate type latex, polyurethane, unsaturated polyether resin, and the like can be used.

In view of the ink absorbency and the strength of the ink receiving layer to be formed, from among the above described binders, polyvinyl alcohol is desirable, and its content is desirable to be not less than 5 mass % and not more than 35 mass % of the entire dry solids content of the ink receiving layer. When the content of the binder in the ink receiving layer is smaller than 5 mass %, the strength of the ink receiving layer becomes insufficient, and when the content of the binder is too much larger than 35 mass %, the ink absorbency often deteriorates. Further, when the content of the binder is larger than this, the recess and projection of the surface caused by the inorganic particle of the ink receiving layer is often occupied by the binder resin. Hence, in such a case, the anchoring with the pigment ink particle is reduced, and the scratch resistance of the printed product becomes inferior.

To the ink receiving layer of the present invention, in addition to the above described materials, can be suitably added a water proofing agent, pigment dispersant, thickener, antifoaming agent, foam inhibitor, mold release agent, fluorescence dye, UV light absorber, antioxidant, surface active agent, antiseptic agent, and the like in such a range as not to damage the effect of the invention.

(Method of Forming Ink Receiving Layer)

The ink receiving layer can be obtained by applying a coating liquid on the substrate and drying the substrate.

As a method of coating, a blade coating method, roll coating method, rod bar coating method, slot die coating method and the like can be used.

Figure 3:
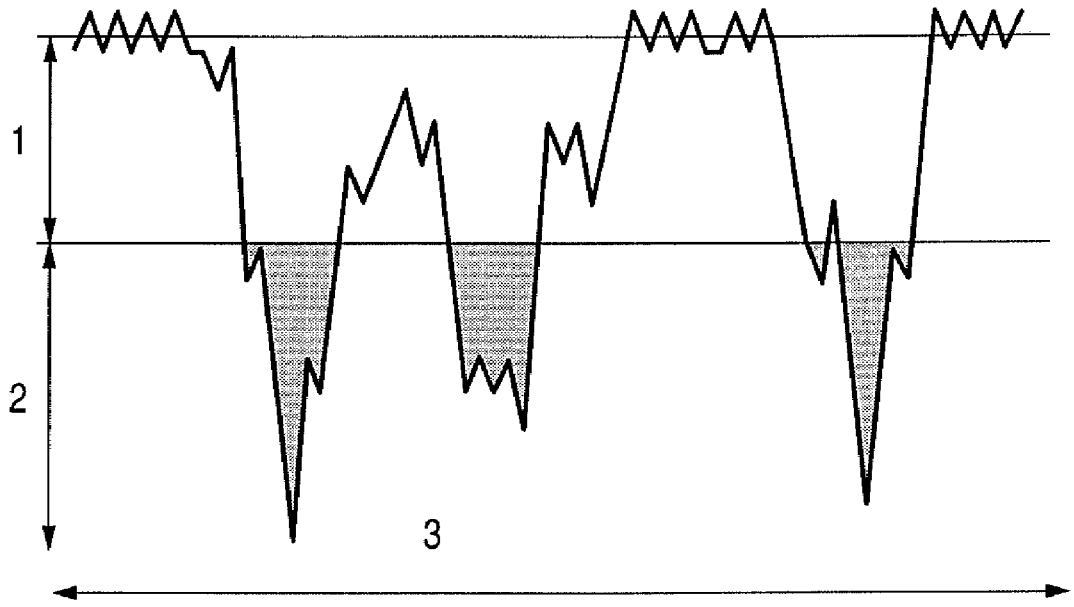
FIG. 3 is a view representing the roughness curve of the ink jet recording medium surface.

Further, after the ink receiving layer is formed, a rewet casting method, a calender processing, and the like can be also applied. By using these methods and processing, as shown in FIG. 3, while the predetermined Ra, S and Rvk are being held, the uppermost surface only of the ink jet recording medium can be smoothed.

By doing so, without harming the anchoring between the ink jet recording medium surface and the pigment ink particle, the smoothness of the ink jet recording medium surface can be improved. Thus, a glossy paper excellent in scratch resistance having a 20° specular gloss of not less than 10% in according to JIS-Z-8741 can be obtained. Incidentally, while the casting method can be classified into a wet method, rewet method, and solidifying method depending on the method of forming a glossy surface, in view of the productivity, the rewet method is preferable.

In this rewet casting method, the coating liquid for the ink receiving layer is applied on the substrate, and after that, the coating liquid is dried once. Then, by the remoistening liquid (rewet liquid), the ink receiving layer is plasticized again, and is closely pressed against a heated mirror drum surface, and is dried and removed from a mold, thereby achieving a high gloss finish. This rewet casting method can smooth the ink receiving layer only and give the layer an excellent gloss.

Incidentally, when the rewet casting method is used, the secondary particle size of alumina hydrate particles can be not less than 230 nm and not more than 300 nm, and can be not more than 280 nm. When the secondary particle size of alumina hydrate particle is smaller than 230 nm, the anchoring is hard to function for the pigment ink remaining on the ink receiving layer, and the scratch resistance performance is often hard to be obtained. On the other hand, when the secondary particle size is larger than 300 nm, the pigment ink particle does not remain on the ink receiving layer, and enters deep inside the ink receiving layer, and as a result, the color developability of the image becomes often deteriorated.

Further, when the casting method or the calender processing is used, as compared with the case where the casting method and the calender processing are not used, media having high glossiness can be obtained. Further, when the casing method and calender processing are used in order to improve the scratch resistance performance much more, as compared with the case where they are not used, the secondary particle size of the alumina hydrate particles is desirable to be made larger within the range where deterioration of color development by the dropping of the pigment ink from the receiving layer surface does not occur.

2. Substrate

As a substrate for providing the ink receiving layer, a paper or a plastic sheet can be used. As a paper, a paper material such as a wood free paper, a coat paper and a baryta paper can be cited, and as a plastic paper, a plastic sheet of polyethylene, polyethylene terephthalate (PET), polyvinyl chloride and the like can be cited.

3. Pigment Ink

The pigment ink in the present invention will be described. When an ink containing a pigment is used, in addition to the pigment, water, a water soluble organic solvent and other components, for example, such as a dispersant, viscosity adjustor, pH adjustor, antiseptic agent, surface active agent and antioxidant are further added as needed.

The content of the pigment in the pigment ink used in the present invention can be, by mass %, in the range of not less than 1 mass % and not more than 20 mass % and can be in the range of not less than 2 mass % and not more than 12 mass % based on the entire ink mass. Further, the average particle size of the pigment can be not less than 80 nm and not more than 100 nm.

As the pigment used in the present invention, to be more specific, as the pigment used for a black ink, a carbon black can be cited. As this carbon black, for example, a carbon black manufactured by a furnace method and a channel method can be cited. As this carbon black, a carbon black having a primary particle size of not less than 15 nm and not more than 40 nm, a specific surface area of not less than 50 $m^2/g$ and not more than 300 $m^2/g$ according to the BET method, and a DBP oil absorption of not less than 40 ml/100 g and not more than 150 ml/100 g can be used. Further, a carbon black having characteristics of a volatile matter content of not less than 0.5% and not more than 10% and a pH value of not less than 2 and not more than 9 and the like can be used.

As commercially available carbon blacks having such a characteristic, for example, No. 2300, No. 900, MCF88, No. 33, No. 40, No. 45, No. 52, MA7, MA8, No. 2200B (made by Mitsubishi Kasei Corp.), RAVEN1255 (made by Colombian Carbon Co.), REGAL400R, REGAL330R, REGAL660R, MOGUL-L (made by Cabot Co.), Color Black FW1, Color Black FW18, Color Black S170, Color Black S150, Printex 35, Printex U (made by Degussa Co.) and the like are available, and any one of those cited above can be used.

Further, as the pigment used for yellow ink, for example, C.I. Pigment Yellow 1, C. I. Pigment Yellow 2, C. I. Pigment Yellow 3, C.I. Pigment Yellow 13, C.I. Pigment Yellow 16, C.I. Pigment Yellow 83 and the like can be cited.

As the pigment used for magenta ink, for example, C.I. Pigment Red 5, C. I. Pigment Red 7, C. I. Pigment Red 12, C.I. Pigment Red 48(Ca), C.I. Pigment Red 48 (Mn), C.I. Pigment Red 57(Ca), C.I. Pigment Red 112, C.I. Pigment Red 122 and the like can be cited.

As the pigment used for cyan ink, for example, C.I. Pigment Blue 1, C. I. Pigment Blue 2, C. I. Pigment Blue 3, C.I. Pigment Blue 15:3, C.I. Pigment Blue 16, C.I. Pigment Blue 22, C.I. Vat Blue 4, C.I. Vat Blue 6, and the like can be cited.

Incidentally, as the pigment used for the inks of black, yellow, magenta and cyan, it is not limited to those described as above. Further, as a dispersant allowed to be contained in the ink when the pigment is used, any dispersant can be used so far as it is a water soluble resin. A dispersant having a weight average molecular weight in the range of not less than 1000 and not more than 30000 can be used, and a dispersant having a weight average molecular weight in the range of not less than 3000 and not more than 15000 can also be used.

As such a dispersant, specifically, a block copolymer, a random copolymer, a graft copolymer, and salts thereof comprising at least two or more monomers (among which, at least one is a hydrophilic monomer) selected from the group consisting of styrene, styrene derivative, vinyl naphthalene, vinyl naphthalene derivative, aliphatic alcohol ester of α-β ethylenically unsaturated carboxylic acids and the like, acrylic acids, acrylic acids derivative, maleic acid, maleic acid derivative, itaconic acid, itaconic acid derivative, fumaric acid, fumaric acid derivative, vinyl acetate, vinyl pyrrolidone, acryl amide, and derivative thereof and the like.

As the dispersant, the natural resin such as rosin, shellac and starch can be preferably used. These resins are soluble in aqueous solutions dissolving a base, and are alkali soluble type resins. Incidentally, the water soluble resin used as these pigment dispersants can be contained in the range of not less than 0.1 mass % and not more than 5 mass % with respect to the entire ink mass.

Further, in the case of the pigment ink, the entire ink can be adjusted to be neutral or alkaline. By doing so, solubility of the water soluble resin used as the pigment dispersant is improved, thereby making the ink much more excellent in a long time storage stability. The ink is desirable to be held in the pH range of not less than 7 and not more than 10.

As a pH adjustor used at this time, for example, various organic amines such as diethanolamine and triethanolamine, inorganic alkali agents such as hydroxides of alkali metals such as sodium hydroxide, lithium hydroxide and potassium hydroxide, as well as organic acids, mineral acids, and the like can be cited.

EXAMPLE

Hereinafter, the present invention will be described more in detail by the examples.

(Preparation of Coating Liquid 11)

Alumina hydrate powder (made by Sasol; Product Name: DISPERAL HP 30, specific surface area: 110 $m^2/g$) was agitated and mixed in de-ionized water, thereby to obtain an alumina hydrate raw dispersion liquid with a dry solid content of 20 wt %. Further, this alumina hydrate raw dispersion liquid was subjected to a dispersion processing by a homogenizer, thereby to obtain an alumina hydrate dispersion liquid. When the average secondary particle size of the alumina hydrate particle in the alumina hydrate raw dispersion liquid was measured by a laser beam scattering diffraction type particle size distribution measuring device LS230 made by Beckman Coulter, it was 280 nm.

To 100 parts by mass of the alumina hydrate dispersion liquid, 20 parts by mass of a 10 wt % aqueous solution of polyvinyl alcohol (JM-26 made by Japan VAM & Poval Co.) was mixed and agitated, and after that, the solution was diluted with de-ionized water, thereby to obtain a coating liquid 11 having a dry solid content of 15 wt %.

(Preparation of Coating Liquid 12)

Alumina hydrate powder (made by Sasol; Product Name: DISPERAL HP 18, specific surface area: 150 $m^2/g$) was agitated and mixed in de-ionized water, thereby to obtain alumina hydrate raw dispersion liquid with a dry solid content of 20 wt %. Further, this alumina hydrate raw dispersion liquid was subjected to a dispersion processing by a homogenizer, thereby to obtain an alumina hydrate dispersion liquid. When the average secondary particle size of the alumina hydrate particle in the alumina hydrate raw dispersion liquid was measured by a laser beam scattering diffraction type particle size distribution measuring device LS230 made by Beckman Coulter, it was 210 nm.

To 100 parts by mass of the alumina hydrate dispersion liquid, 20 parts by mass of a 10 wt % aqueous solution of polyvinyl alcohol (JM-26 made by Japan VAM & Poval Co.) was mixed and agitated, and after that, the solution was diluted with de-ionized water, thereby to obtain a coating liquid 12 with a dry solid content of 15 wt %.

(Preparation of Coating Liquid 13)

Alumina hydrate powder (made by Sasol; Product Name: DISPERAL HP 22, specific surface area 150 $m^2/g$) was agitated and mixed in de-ionized water, thereby to obtain an alumina hydrate raw dispersion liquid with a dry solid content of 20 wt %. Further, this alumina hydrate raw dispersion liquid was subjected to a dispersion processing by a homogenizer, thereby to obtain an alumina hydrate dispersion liquid. When an average secondary particle size of the alumina hydrate particle in the alumina hydrate raw dispersion liquid was measured by a laser beam scattering diffraction particle size distribution measuring device LS230 made by Beckman Coulter, it was 230 nm.

To 100 parts by mass of the alumina hydrate dispersion liquid, 20 parts by mass of a 10 wt % aqueous solution of polyvinyl alcohol (JM-26 made by Japan VAM & Poval Co.) was mixed and agitated, and after that, the solution was diluted with de-ionized water, thereby to obtain a coating liquid 13 with a dry solid content of 15 wt %.

(Preparation of Coating Liquid 14)

Alumina hydrate powder (made by Sasol; Product Name: DISPERAL HP 14, specific surface area 180 $m^2/g$) was agitated and mixed in de-ionized water, thereby to obtain an alumina hydrate raw dispersion liquid with a dry solid content of 20 wt %. Further, this alumina hydrate raw dispersion liquid was subjected to a dispersion processing by a homogenizer, thereby to obtain an alumina hydrate dispersion liquid. When the average secondary particle size of the alumina hydrate particle in the alumina hydrate raw dispersion liquid was measured by a laser beam scattering diffraction particle size distribution measuring device LS230 made by Beckman Coulter, it was 170 nm.

To 100 parts by mass of the alumina hydrate dispersion liquid, 20 parts by mass of a 10 wt % aqueous solution of polyvinyl alcohol (JM-26 made by Japan VAM & Poval Co.) was mixed and agitated, and after that, the solution was diluted with de-ionized water, thereby to obtain a coating liquid 14 with a dry solid content of 15 wt %.

(Preparation of Coating Liquid 15)

Alumina hydrate powder (made by Sasol; Product Name: DISPERAL HP 40, specific surface area: 100 $m^2/g$) was agitated and mixed in de-ionized water, thereby to obtain an alumina hydrate raw dispersion liquid with a dry solid content of 20 wt %. Further, this alumina hydrate raw dispersion liquid was subjected to a dispersion processing by a homogenizer, thereby to obtain alumina hydrate dispersion liquid. When the average secondary particle size of the alumina hydrate particle in the alumina hydrate raw dispersion liquid was measured by a laser beam scattering diffraction particle size distribution measuring device LS230 made by Beckman Coulter, it was 350 nm.

To 100 parts by mass of the alumina hydrate dispersion liquid, 20 parts by mass of a 10 wt % aqueous solution of polyvinyl alcohol (JM-26 made by Japan VAM & Poval Co.) was mixed and agitated, and after that, the solution was diluted by de-ionized water, thereby to obtain a coating liquid 15 with a dry solid content of 15 wt %.

(Preparation of Coating Liquid 16)

Wet silica (made by Tokuyama Corp., product name: Finesil X-60) was agitated and mixed in de-ionized water, thereby to obtain a silica dispersion liquid with a solid content of 20 wt %. When the average secondary particle size of the silica particle in the obtained silica dispersion liquid was measured by the same method as used for the coating liquid 11, it was 7 μm.

To 100 parts by mass of the silica dispersion liquid, 65 parts by mass of a 10 wt % aqueous solution of polyvinyl alcohol (KURARAY POVAL PVA-117 made by KURARAY CO. LTD.) was mixed and agitated, and after that, the solution was diluted with de-ionized water, thereby to obtain a coating liquid 16 with a dry solid content of 15 wt %.

Example 1

As a substrate, a wood free paper having a basis weight of 185 $g/m^2$ was used, and the coating liquid 11 was applied on this paper by a slot dye coater so as to become 25 $g/m^2$ in absolute dry amount, and after that, it was dried, so that an ink jet recording medium was obtained.

Example 2

Purified water was used as a rewet liquid for the recording medium obtained by the example 1, and while the coated surface was in a humid state, this was pressed to a cast drum of 100° C. in surface temperature, thereby to obtain an ink jet recording medium subjected to a cast treatment.

Example 3

As a substrate, a resin coat paper (RC paper) for photographic paper having a basis weight of 130 $g/m^2$ was used, and the coating liquid 11 was applied on this paper by a slot dye coater so as to become 40 $g/m^2$ in absolute dry amount, and after that, it was dried, so that an ink jet recording medium was obtained.

Example 4

As a substrate, a wood free paper of having a basis weight of 185 $g/m^2$ was used, and the coating liquid 12 was applied on this paper by a slot dye coater so as to become 25 $g/m^2$ in absolute dry amount, and after that, it was dried, so that an ink jet recording medium was obtained.

Example 5

As a substrate, a wood free paper having a basis weight of 185 $g/m^2$ was used, and the coating liquid 13 was applied on this paper by a slot dye coater so as to become 25 $g/m^2$ in absolute dry amount, and after that, it was dried, so that an ink jet recording medium was obtained.

Example 6

Purified water was used as a rewet liquid for the recording medium obtained by the example 5, and while the coated surface was in a humid state, this was pressed to a cast drum of 100° C. in surface temperature, thereby to obtain an ink jet recording medium subjected to a cast treatment.

Example 7

As a substrate, a resin coat paper (RC paper) for photographic paper having a basis weight of 130 $g/m^2$ was used, and the coating liquid 13 was applied on this paper by a slot dye coater so as to become 40 $g/m^2$ in absolute dry amount, and after that, it was dried, so that an ink jet recording medium was obtained.

Comparison Example 1

As a substrate, a resin coat paper (RC paper) for photographic paper having a basis weight of 130 $g/m^2$ was used, and the coating liquid 14 was applied on this paper by a slot dye coater so as to become 40 $g/m^2$ in absolute dry amount, and after that, it was dried, so that an ink jet recording medium was obtained.

Comparison Example 2

As a substrate, a wood free paper having a basis weight of 185 $g/m^2$ was used, and the coating liquid 14 was applied on this paper by a slot dye coater so as to become 25 $g/m^2$ in absolute dry amount, and after that, it was dried, so that an ink jet recording medium was obtained.

Comparison Example 3

Purified water was used as a rewet liquid for the recording medium obtained by the comparison example 2, and while the coated surface was in a humid state, this was pressed to a cast drum of 100° C. in surface temperature, thereby to obtain an ink jet recording medium subjected to a cast treatment.

Comparison Example 4

Purified water was used as a rewet liquid for the recording medium obtained by the example 4, and while the coated surface was in a humid state, this was pressed to a cast drum of 100° C. in surface temperature, thereby to obtain an ink jet recording medium subjected to a cast treatment.

Comparison Example 5

As a substrate, a resin coat paper (RC paper) for photographic paper having a basis weight of 130 g/m$^2$ was used, and this paper was coated with the coating liquid 15 by a slot dye coater so as to become 40 g/m$^2$ in absolute dry amount, and after that, it was dried, so that an ink jet recording medium was obtained.

Comparison Example 6

As a substrate, a wood free paper having a basis weight of 185 g/m$^2$ was used, and this paper was coated with the coating liquid 15 by a slot dye coater so as to become 25 g/m$^2$ in absolute dry amount, and after that, it was dried, so that an ink jet recording medium was obtained.

Further, purified water was used as a rewet liquid for the recording medium obtained as described above, and while the coated surface was in a humid state, this was pressed to a cast drum of 100° C. in surface temperature, thereby to obtain an ink jet recording medium subjected to a cast treatment.

Comparison Example 7

As a substrate, a resin coat paper (RC paper) for photographic paper having a basis weight of 130 g/m$^2$ was used, and this paper was coated with the coating liquid 16 by a slot dye coater so as to become 30 g/m$^2$ in absolute dry amount, and after that, it was dried, so that an ink jet recording medium was obtained.

(Evaluation Method of Surface Profile of Ink Receiving Layer)

The surface profile of the ink receiving layer of the ink jet recording mediums prepared in the examples and the comparison examples was evaluated by a scanning probe microscope (product name: Nanopics 2100) made by Seiko Instrument Inc. The measurement was performed on a region of 4 μm×4 μm, and a cut off value (λc) at a time of measuring the arithmetic average roughness (Ra) was taken as 1.3 λm, and a reference length at a time of measuring the average spacing (S) of the local peaks was taken as 4 λm. Further, from among the 256 lines obtained by measurement for the measurement region, ten lines were sampled, and the mean value thereof was taken.

With respect to the roughness curve measured under this condition, the arithmetic average roughness (Ra), the projected valley portion depth (Rvk), and the average spacing (S) of the local peaks were measured. Incidentally, the arithmetic average roughness (Ra) was measured according to JIS-B-0601(2001) except for the above described condition. The average spacing (S) of the local peaks was measured according to JIS-B-0601 (1994) except for the above described condition. Further, the projected valley portion depth (Rvk) was measured according to JIS-B-0671-2.

When the arithmetic average roughness (Ra), the projected valley portion depth (Rvk), and the average spacing (S) of the local peaks were measured according to the above described method, in case any one of the conditions that (a) Rvk is not less than 20 nm and not more than 100 nm, (b) Ra is not less than 5 nm and not more than 100 nm, and (c) S is not more than 1.0 μm was not satisfied, the ink jet recording medium was taken as an ink jet recording medium outside the range of the present invention. Particularly, with respect to the ink receiving layer of the comparison example 7, since the particle size of the silica particle is 7 μm, when the arithmetic average roughness was measured according to the above described method, it was of the order of several μm. Thus, it was outside the condition (b), and at the same time, the measurement was unable to be performed since the arithmetic average roughness was too large to be measured according to the above described method. Hence, for this sample alone, only Ra was measured by a surface roughness measuring instrument SJ-201 made by Mitsutoyo-Kiko Co. Ltd.

(Evaluation of Printed Product)

As a printer, an ImagePROGRAPH 6400 made by Cannon Inc. was used, and a patch image with an ink duty of 160% with the pigment ink of Bk ink (BCI-1431 Bk) was printed, and the following evaluation was made. 1200×1200 dots printed per square inch is regarded as an ink duty of 100%.

Incidentally, when a particle distribution measuring device (product name: Nano truck UPA-150 made by NIKKISO CO. LTD) was used to measure the particle size of the pigment particle was measured, an average particle size was 96 nm.

(1) Scratch Resistance Evaluation

After printing, the image was left standing in a room for 24 hours, and after it was sufficiently dried, it was strongly scratched by a claw.

The printed product in which the printed image was scraped off and the white substrate largely appeared was taken as C, that in which the white substrate slightly appeared was taken as B, and that in which the white substrate did not appear was taken as A.

(2) Image Density (OD) Evaluation

After printing, the image was left standing in a room for 24 hours, and was sufficiently dried, and after that, the image density was measured by using a reflection densitometer (Mcbeth SERIES 1200 (Product Name) made by Mcbeth Corp.). Incidentally, if the image density is not less than 2.0, practically, it is sufficiently satisfactory, and if it is less than 2.0, it is evaluated inferior.

(3) Glossiness Evaluation

The 20° specular gloss at a non-printing portion of the recording medium was measured according to JIS-Z-8741. As for the 20° specular gloss, if it is not less than 1.5% and less than 10%, it is sufficiently satisfactory as a semi-glossy paper, and if it is not less than 10%, it is evaluated satisfactorily as a glossy paper.

The result of the measurement as described above is shown in the following Table.

TABLE 1

| | TYPE OF COATING LIQUID | TYPE OF SUBSTRATE | CASTING PROCESSING | Ra (nm) | Rvk (nm) | S (μm) | SCRATCH RESISTANCE | 20° SPECULAR GLOSS(%) | OD OF BK INK |
|---|---|---|---|---|---|---|---|---|---|
| EXAMPLE 1 | 11 | WOOD FREE PAPER | No | 54 | 55 | 0.8 | A | 1.8 | 2.2 |
| EXAMPLE 2 | 11 | WOOD FREE PAPER | Yes | 11 | 28 | 0.7 | A | 10.6 | 2.4 |
| EXAMPLE 3 | 11 | RC PAPER | No | 50 | 52 | 0.8 | A | 2.0 | 2.2 |
| EXAMPLE 4 | 12 | WOOD FREE PAPER | No | 31 | 51 | 0.6 | A | 3.1 | 2.3 |
| EXAMPLE 5 | 13 | WOOD FREE PAPER | No | 42 | 47 | 0.7 | A | 2.3 | 2.3 |
| EXAMPLE 6 | 13 | WOOD FREE PAPER | Yes | 9 | 25 | 0.6 | B | 12.5 | 2.4 |
| EXAMPLE 7 | 13 | RC PAPER | No | 41 | 47 | 0.7 | A | 2.8 | 2.3 |
| COMPARISON EXAMPLE 1 | 14 | RC PAPER | No | 16 | 17 | 0.5 | C | 9.5 | 2.3 |
| COMPARISON EXAMPLE 2 | 14 | WOOD FREE PAPER | No | 19 | 18 | 0.4 | C | 7.5 | 2.3 |
| COMPARISON EXAMPLE 3 | 14 | WOOD FREE PAPER | Yes | 5 | 8 | 0.4 | C | 25.0 | 2.3 |
| COMPARISON EXAMPLE 4 | 12 | WOOD FREE PAPER | Yes | 7 | 13 | 0.5 | C | 15.0 | 2.3 |
| COMPARISON EXAMPLE 5 | 15 | RC PAPER | No | 104 | 130 | 1.1 | A | 1.0 | 1.8 |
| COMPARISON EXAMPLE 6 | 15 | WOOD FREE PAPER | Yes | 101 | 125 | 1.1 | A | 1.0 | 1.8 |
| COMPARISON EXAMPLE 7 | 16 | RC PAPER | No | 3 | — | — | A | NOT MORE THAN 1 | 1.6 |

From the results of the examples of Table 1, it is clear that, by setting Rvk at not less than 20 nm and not more than 100 nm, Ra at not less than 5 nm and not more than 100 nm, and S at not more than 1.0 μm, the excellent results were obtained with respect to the scratch resistance, high color development and glossiness. Specifically, the scratch resistance was evaluated as A or B, and the 20° specular gloss became not less than 1.8%, and the OD became not less than 2.2.

On the other hand, in the comparison examples, the scratch resistance was evaluated as C, the glossiness was evaluated as not more than 1, and the OD was evaluated less than 2. Hence, if any one of Rvk, Ra and S is outside the above described range, it is clear that the ink jet recording medium satisfying the image characteristics of both scratch resistance as well as high color development and glossiness is difficult to obtain.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-098787, filed Mar. 31, 2006, and Japanese Patent Application No. 2007-068846, filed Mar. 16, 2007, which are hereby incorporated by reference herein in their entirety.

What is claimed is:

1. An ink jet recording medium, comprising a substrate and an ink receiving layer including an inorganic particle and a binder on the substrate, wherein the ink receiving layer is an uppermost layer of the ink jet recording medium, wherein a surface of the ink receiving layer has:

(a) a projected valley portion depth (Rvk) of not less than 20 nm and not more than 100 nm, (b) an arithmetic average roughness (Ra) of not less than 5 nm and not more than 100 nm, and (c) an average spacing (S) of local peaks of not more than 1.0 μm, and wherein one surface of the ink receiving layer is in contact with the substrate, and the other surface of the ink receiving layer satisfies the features (a), (b) and (c).

2. The ink jet recording medium according to claim 1, wherein the inorganic particle is an alumina hydrate particle having an average secondary particle size of not less than 210 nm and not more than 300 nm.

3. The ink jet recording medium according to claim 1, wherein the inorganic particle is an alumina hydrate particle having an average secondary particle size of not less than 230 nm and not more than 300 nm, and wherein the ink receiving layer is formed by a rewet casting method.

4. The ink jet recording medium according to claim 1, wherein the projected valley portion depth (Rvk) is not less than 20 nm and not more than 60 nm.

5. A method of manufacturing the ink jet recording medium according to claim 1, comprising the steps of applying an ink receiving layer coating liquid containing an alumina hydrate particle having an average secondary particle size of not less than 230 nm and not more than 300 nm on the substrate and performing a rewet casting method.

* * * * *